US005426451A

United States Patent [19]

Brock et al.

[11] Patent Number: 5,426,451

[45] Date of Patent: Jun. 20, 1995

[54] PRINT HEAD WITH PIXEL SIZE CONTROL FOR RESISTIVE RIBBON THERMAL TRANSFER PRINTING

[75] Inventors: George W. Brock, La Jolla; Jeremiah F. Connolly, San Diego; Kent R. Gandola, Poway, all of Calif.

[73] Assignee: Eastman Kodak Company, Rochester, N.Y.

[21] Appl. No.: 86,777

[22] Filed: Jul. 1, 1993

[51] Int. Cl.[6] ..... B41J 2/395; B41J 2/39

[52] U.S. Cl. ..... 347/199; 347/208

[58] Field of Search ..... 346/76 PH, 155, 139 C; 400/120

[56] References Cited

U.S. PATENT DOCUMENTS

| | | | |
|---|---|---|---|
| 3,553,424 | 1/1971 | Spaulding | 219/388 |
| 3,862,394 | 1/1975 | Lane, III | 219/216 |
| 4,170,728 | 10/1979 | Flasck | 219/216 |
| 4,194,108 | 3/1980 | Nakajima et al. | 219/216 |
| 4,350,449 | 9/1982 | Countryman et al. | 400/120 |
| 4,484,200 | 11/1984 | Tabata et al. | 346/76 PH |
| 4,684,960 | 8/1987 | Nishiwaki et al. | 346/76 PH |
| 4,689,639 | 8/1987 | Kimura et al. | 346/76 PH |
| 4,691,210 | 9/1987 | Nishiguchi et al. | 346/76 PH |
| 4,703,331 | 10/1987 | Stevens, Jr. | 346/140 R |

FOREIGN PATENT DOCUMENTS

| | | | |
|---|---|---|---|
| 62-99162 | 5/1987 | Japan | H01M 2/04 |
| 0188067 | 8/1988 | Japan | 346/76 PH |

OTHER PUBLICATIONS

IBM Technical Disclosure Bulletin, vol. 26, No. 10A, Mar. 1984, Fathergill et al., Flexible Electrode Printhead With Heat Sink.

*Primary Examiner*—Huan H. Tran
*Attorney, Agent, or Firm*—Milton S. Sales

[57] ABSTRACT

A print head applies electrical energy to an electrically resistive and grounded transfer ribbon bearing heat transferable dye, during sliding pressure contact and relative movement between the head and ribbon, for resistive heating of the dye to a transfer temperature for transfer to a receiver to form images of selective pixel size thereon. The head has a row of electrodes with end faces and an electrically non-conductive substrate with an end face, the end faces lying in a contact plane for contact with the ribbon. A groove in the substrate end face separates such end face from the electrode end faces. The width of the groove is sufficient to inhibit heat transfer at the groove from the ribbon to the substrate for controlling the dye amount heated to transfer temperature adjacent the groove during the relative movement and in turn the image pixel size.

12 Claims, 5 Drawing Sheets

PRINT HEAD WITH PIXEL SIZE CONTROL FOR RESISTIVE RIBBON THERMAL TRANSFER PRINTING

CROSS-REFERENCE TO RELATED PATENT APPLICATIONS

This Patent Application is related to:

(1) U.S. patent application Ser. No. 08/086,742 (George W. Brock and Jeremiah F. Connolly), which is being filed simultaneously herewith and has a common assignee and two common inventors with this patent application, and which is entitled "PRINT HEAD WITH ELECTRODE TEMPERATURE CONTROL FOR RESISTIVE RIBBON THERMAL TRANSFER PRINTING;" and (2) U.S. patent application Ser. No. 08/086,496 (George W. Brock), which is being filed simultaneously herewith and has a common assignee and one common inventor with this patent application, and which is entitled "SELF-FUSING IMAGE PRODUCING PRINT HEAD FOR RESISTIVE RIBBON THERMAL TRANSFER PRINTING."

FIELD OF THE INVENTION

This invention relates to a print head with pixel size control for resistive ribbon thermal transfer printing.

BACKGROUND OF THE INVENTION

Various printing systems are known for recording (printing) character (text) or graphic (picture) images on a recording medium (receiver) such as a paper or polymer sheet. Examples thereof are set forth in the following prior art.

U.S. Pat. No. 3,553,424 (Spaulding), issued Jan. 5, 1971, discloses heat stabilizing (fixing) of latent images on spectrally sensitized, i.e., photographic emulsion, printout paper, by passing the paper along a multi-zone heating surface segregated by groove and stepped portions for progressive heating, followed by cooling.

U.S. Pat. No. 4,703,331 (Stevens, Jr.), issued Oct. 27, 1987, discloses a spark jet printer with a plurality of spark jet units, each having a spring-fed consumable, solid ink electrode with an end adjacent the end of a fixed counter electrode energized for issuing an ink spark jet to form images on paper.

U.S. Pat. No. 3,862,394 (Lane, III), issued Jan. 21, 1975, discloses a thermal print head with a trifluoro methylene coated, triangular shaped aluminum substrate having an apex forming a print edge across which electrically insulated copper plated wires extend. The insulation and copper plate are removed from the wires at the apex to form resistance heaters thereat.

U.S. Pat. No. 4,689,639 (Kimura et al.), issued Aug. 25, 1987, discloses a thermal print head with heating elements in a groove or on an edge portion thereof to heat an ink film (donor web) for ink transfer to paper to form images thereon.

U.S. Pat. No. 4,691,210 (Nishiguchi et al.), issued Sep. 1, 1987, discloses a thermal print head for heat sensitive recording, with heating elements separated from an alumina ceramic substrate by a glaze layer, mainly of silica, about 35 to 50 microns (0.0014 to 0,002 inch) thick. The elements have an inner heat generating resistor layer of tantalum nitride or titanium oxide (TiO), and an outer layer of pairs of aluminum or gold conductor electrodes. The elements are overcoated by a protecting layer of tantalum pentoxide. The type of thermal recording effected with the print head is not indicated.

U.S. Pat. No. 4,194,108 (Nakajima et al.), issued Mar. 18, 1980, discloses a thermal print head with groove separated resistance heaters for forming images in thermally sensitive paper at 500 degrees C. under a 200 gram per sq. cm. (2.8 psi) force.

U.S. Pat. No. 4,170,728 (Flasck), issued Oct. 9, 1979, discloses a thermal print head having an apex edge with non-conductive cement coated, side by side bent wire threads forming resistance heaters protruding from side by side notches in a metal heat sink support body coated with an anodized oxide insulating layer. The apex edge is encapsulated in an insulating potting material acting as a heat sink. The protruding threads contact and heat a heat responsive recording sheet to form images therein.

U.S. Pat. No. 4,350,449 (Countryman et al.), issued Sep. 21, 1982, discloses a resistive ribbon thermal transfer print head with a row of side by side, spaced apart, electrodes for sliding pressure contact with a fusible (meltable) ink bearing resistive ribbon overlying conventional paper on a platen. Electrothermic printing of images is effected by transfer of melted ink from the ribbon to the paper under high print head force during movement of the head relative to the ribbon and paper. The electrodes, which are of unidentified material, are embedded in a thin insulating layer between plates of unidentified material, and have exposed, ribbon contacting electrode ends. The ribbon has an upper, print head contacting resistive layer, an intermediate conductive ground layer of aluminum with a thin insulating layer of aluminum oxide, and a lower ink layer. Electrode energizing resistively heats discrete ribbon areas to release ink for transfer to the paper. The ground layer provides a short current path from the electrodes through the resistive layer for localized heating of contiguous ink portions in the ink layer, with current return from the ground layer to ground via an element remote from the electrodes. For imaging thermally sensitive paper, the ink layer is omitted from the ribbon.

IBM Technical Disclosure Bulletin, Vol. 26, No. 10A, Mar. 1984 (Fathergill et al.), discloses a flexible electrode, multi-layer print head used for resistance ribbon printing to generate high temperatures near the print electrode tips which follow the ribbon closely during printing. As the heat is produced in the ribbon, high temperatures in the head are not required. The head has a first compliant layer of silicone rubber supporting a second heat sink layer of vacuum deposited copper or aluminum, coated by a third heat resistant resin layer, carrying a fourth thermally conductive adhesive layer for adhering thereto a fifth tungsten electrode layer which is overcoated by a sixth heat resistant resin top layer. The second heat sink layer protects the head from injury from heat while not adding undue rigidity thereto.

U.S. Pat. No. 4,484,200 (Tabata et al.), issued Nov. 20, 1984, discloses a recording head with an electrically insulating, epoxy resin support containing a row of side by side, spaced apart, recording electrodes and a common opposed return electrode. The head contacts a moving ribbon bearing electroconductive heat transferable, wax based ink for transfer to paper by Joule heat generated in the ribbon by image delineating current applied by selected recording electrodes, with current return via the return electrode. The resin support of the head has a contact surface at which the adjacent ends of the electrodes contact the ribbon. A transverse groove in the contact surface between the recording electrode ends and the return electrode end prevents ink from adhering to the head during printing. An exemplified ribbon has a carbon black loaded polyvinyl butyral resin base layer coated with a carbon black containing wax of 60 degrees C. melting point.

Japanese Patent Laid-Open No. 99,162/87 (Mormose), dated May 8, 1987 (per English translation), discloses a four layer recording head that contacts the resistance layer of a heat transfer sheet (ribbon) having a fusible ink layer, for passing current to fuse the ink for thermoelectric transfer to a recording sheet as image forming dots. The head has a first substrate layer of mica ceramics supporting a second layer of a row of side by side, spaced apart, recording electrodes, e.g., tungsten wires, of 250 micron (0.01 inch) pitch (center to center electrode distance). The recording electrodes may be secured to the first layer by an adhesive, e.g., silicon dioxide. A third spacer layer of heat resisting resin, e.g., polyimide, of thickness close to the recording electrode pitch, e.g., a thickness of 150 microns (0,006 inch), separates the second layer of recording electrodes from a fourth common return electrode layer. The distance between the recording electrodes and return electrode, which determines the occurrence of cross talk and unequal size printed image dots, depends on the third spacer layer thickness accuracy, rendering irrelevant the first substrate layer thickness accuracy.

U.S. Pat. No. 4,684,960 (Nishiwaki), issued Aug. 4, 1987, discloses a print head with a row of side by side, spaced apart, alternating polarity, recording electrodes, e.g., of positive polarity, and return electrodes, e.g., of negative polarity, such as tungsten, molybdenum and/or manganese electrodes, i.e., metal electrodes of relatively low hardness, of 10 to 30 micron (0.0004 to 0.0012 inch) thickness, supported on a common ceramic substrate of alumina, forsterite, etc., such as of 0.5 to 3 mm (500 to 3,000 micron; 0.02 to 0.12 inch) thickness. The electrodes and substrate have end faces in a contact plane for sliding contact with an electrothermal ink bearing transfer film (resistive ribbon) overlying paper on the resilient surface of a platen, e.g., under a low contact pressure of 1.2 to 2.2 kg per sq. cm. (17 to 31 psi), for heat transfer of wax based ink from the resistive ribbon to the paper to form images thereon. The ribbon may have an electrically conductive (resistive) first contact layer of a carbon powder containing resin, an optional supporting second layer of polyethylene terephthalate, and a third ink layer of wax and a pigment or dye that is fusible at 60 degrees C. The contact plane of the electrode and substrate ends is at an acute angle to the plane of the substrate supported row of electrodes.

A second embodiment has a ribbon with a first contact layer of high electrical resistance, a second metal or carbon layer of low electrical resistance, an optional third tensile layer, and a fourth (wax based) ink layer. The print head has recording electrodes perpendicular to the ribbon, and return electrode spikes remote from the print head to pierce the ribbon for conductive contact with the second layer to complete the circuit. A third embodiment has a print head with a row of recording electrodes and an opposed common return electrode akin to Tabata et al. discussed above.

It is noted that a resistive ribbon thermal transfer print head has electrodes that supply current to a resistive ribbon to generate heat in the ribbon to heat the dye therein. On the other hand, a thermal print head has resistors that generate heat in the head for transfer to a donor web to heat the dye therein.

In resistive ribbon thermal printing, heat is generated in an electrically resistive ribbon bearing thermally transferable dye when current flows through the resistive layer and ground layer (return electrode) materials of the ribbon. This is commonly referred to as Joule heating. Current is supplied to the ribbon by a linear array of discrete, electrically conductive electrodes in the print head, i.e., a row of side by side, spaced apart, electrodes mechanically supported by a substrate. Modulated current is fed to the electrodes as current pulses via conductors.

The resistive ribbon typically has an upper base layer of electrically resistive polymer for contacting the electrodes, an intermediate electrically resistive ground layer of conductive material, e.g., aluminum, on which an electrically resistive oxide layer, e.g., aluminum oxide, forms (grows), and a lower layer of dye heatable to a transfer temperature for transfer to a receiver.

There are three primary resistances in the ribbon current flow path. The first is the "contact" resistance at the contact interface between the electrodes and ribbon. The second is the "bulk" resistance at the bulk (mass) of the base layer resistive polymer. The third is the "interface" resistance at the interface of the conductive ground layer, e.g., aluminum, and its resistive oxide layer. The heat generated at each of these resistances contributes to the transfer of dye from the ribbon to the receiver.

A high force is required at the contact interface of the print head and ribbon for good compliance therebetween. This force, plus the high temperature that can occur in printing, unless controlled, can damage the ribbon and limit the electrical energy supplied thereto by the electrodes, making the operation energy inefficient.

Image quality is affected by the temperature profile in the dye mass being transferred. This profile is adversely influenced by the significant energy lost by heat transfer from the ribbon to the electrodes which heats the electrodes. This heat is conducted away from the electrodes by the substrate at a rate determined by the thermal conductivity of the substrate, typically a ceramic material such as steatite, alumina or magnesia.

A low thermal conductivity substrate, typically of 2 to 20 W/m.C. (watts per meter per degree C.), such as steatite or alumina (95.0% purity) is normally used. This limits the operation to slow printing speeds and character (text) image production. If operated at faster printing speeds or for producing near-photographic (picture) images, dye trails (bleeding) and ribbon damage can occur due to slow electrode cool down.

Use of a substrate of high thermal conductivity, typically of 20 to 80 W/m.C., or higher, such as alumina (at least 99% purity) or magnesia, rapidly conducts heat away from the electrodes for fast electrode cool down, but can deprive the dye in the ribbon of the heat needed to transfer a proper dye amount to the receiver, particularly if the substrate has an exposed end face (contact face) in sliding contact with the resistive ribbon.

It is desirable to provide a print head having electrodes supported by a substrate for resistive ribbon thermal transfer printing, with means to control the transferred dye pixel size.

SUMMARY OF THE INVENTION

The drawbacks of the prior art are obviated in accordance with the present invention by providing a print head having electrodes supported by a substrate for resistive ribbon thermal transfer printing, with a substrate groove that controls the pixel size of the transferred dye.

Specifically, a print head construction is provided which spaces (isolates) the electrodes from the supporting substrate at their end faces by a groove having a width sufficient to inhibit heat transfer thereat from the resistive ribbon to the substrate to control the dye amount heated to transfer temperature adjacent the groove and thus the image pixel size. The groove delays heat transfer from the ribbon to the substrate during relative movement between the print head and ribbon, as a function of groove width for a given (fixed) movement speed per unit time. The increase in sliding contact pressure between the print head and ribbon at the end faces of the electrodes and substrate, consequent the slight decrease in substrate end face area caused by the groove, is not significant compared to the pixel size control achieved.

A print head is thus contemplated for selectively applying electrical energy to a contact surface of an electrically resistive and grounded transfer ribbon bearing heat transferable dye, during sliding pressure contact and relative movement between the print head and ribbon in a movement direction, for selective resistive heating of the dye for transfer to a receiver underlying the ribbon remote from the ribbon contact surface and print head to form images of selective pixel size on the receiver, under pixel size control.

The print head comprises a row of side by side, spaced apart, selectively electrically energizable electrodes comprising electrically conductive, high hardness non-oxide ceramic material, e.g., refractory (heat-resistant) material, especially having a Vickers hardness of at least about 1,500 (Hv). The print head further comprises an electrically non-conductive substrate having a selective thermal conductivity comprising electrically non-conductive, high hardness ceramic material, e.g., refractory material, especially having a Vickers hardness of at least about 500 (Hv), and a spacing groove interposed between the electrodes and substrate.

The row of electrodes lies in an electrode plane that extends crosswise of the movement direction, the electrodes terminating in a corresponding row of exposed electrode end faces. The substrate terminates in an adjacent exposed substrate end face. The groove is defined in the substrate end face and extends crosswise of the movement direction, and has a groove entrance.

The row of electrodes in the electrode plane and the substrate are in abutment in succession in the movement direction. The groove is interposed to define a boundary therebetween thermally separating the electrodes from the substrate at their corresponding end faces. The row of electrode end faces, the groove entrance and the substrate end face lie in a contact plane for sliding pressure contact of the electrode end faces and substrate end face with the ribbon contact surface to apply electrical energy from the electrodes to the ribbon to heat the dye to a transfer temperature.

The groove entrance has a selective width between the row of electrodes and the substrate, e.g. at least about 20 microns (0.0008 inch), such as about 20 to 50 microns (0.0008 to 0.002 inch), sufficient to inhibit heat transfer at the groove from the ribbon contact surface to the substrate to control the amount of dye heated to the transfer temperature adjacent the groove during such relative movement and in turn the pixel size of the images formed on the receiver. The groove may have a shallow depth inwardly into the substrate, e.g., of at least about 10 microns (0.0004 inch).

The electrodes may comprise electrically conductive non-oxide ceramic material such as a carbide ceramic or nitride ceramic material, e.g., a metal carbide, metal nitride or non-metal carbide, and in particular tungsten carbide, silicon carbide, zirconium carbide, titanium carbide, titanium nitride, and the like, of at least about 1,500 Vickers hardness. For optimum electric current conduction from the electrodes to the resistive ribbon, the electrode material is chosen to have a higher wear resistance than the substrate material to minimize electrode recession (wear) below the contact face plane of the print head, i.e., the contact plane in which the electrode end faces and substrate end face are normally disposed for sliding pressure contact with the resistive ribbon. Metal electrodes are not contemplated as they possess insufficient hardness, e.g., Vickers hardness, and wear resistance, metals being relatively soft and subject to accelerated wear under the extant operating conditions.

The substrate may comprise electrically non-conductive ceramic material such as an oxide ceramic, nitride ceramic or glass-ceramic material, e.g., a metal oxide (including mixed metal oxide), metal nitride, mixed metal oxide and non-metal oxide, or glass-ceramic, and in particular beryllium oxide, aluminum nitride, magnesia (magnesium oxide), alumina (aluminum oxide), magnesium aluminate, titania (titanium oxide), calcium titanate, barium titanate, zirconia (zirconium oxide), forsterite, steatite, fotoceram, pyroceram, and the like, of at least about 500 Vickers hardness.

Fotoceram (product of Dow Corning Co., NY) is a conventional ceramic material (glass-ceramic) initially having the form and attributes (properties) of glass, which can be molded like glass, but which upon exposure to light irradiation and heat treatment crystallizes to a ceramic substance, such that any areas thereof which are not exposed to light irradiation (masked areas) can be etched away to provide a selectively shaped glass-ceramic composite (structure).

Pyroceram is a conventional ceramic material (glass-ceramic) having the properties of both a glass and a ceramic substance.

As used herein, the term "ceramic material" connotes a hard (high hardness) refractory (heat-resistant) material, e.g., (i) formed of a metal carbide, metal nitride or non-metal carbide (i.e., a non-oxide ceramic) having electrical conductivity and thermal conductivity in the case of the electrodes herein, or (ii) formed of a metal oxide (including mixed metal oxide such as magnesium aluminate and barium titanate), metal nitride, mixed metal oxide and non-metal oxide (e.g., forsterite and steatite), or glass-ceramic (e.g., fotoceram or pyroceram), having electrical resistivity (electrical non-conductivity) and selective thermal conductivity in the case of the substrate herein.

The print head may further comprise a heat sink element connected to the substrate remote from the groove and electrodes. The contact plane that contains the electrode end faces, groove entrance and substrate end face, typically extends at an acute angle to the electrode plane.

This invention also contemplates the combination of the above described print head with an electrically resistive dye transfer ribbon comprising an upper electrically resistive base layer, an intermediate electrically resistive ground layer, and a lower heat transferable dye bearing layer. The dye layer comprises dye heatable to a transfer temperature for transfer to the receiver. The base layer defines the ribbon contact surface which contacts the end faces of the electrodes and substrate. The base layer and ground layer serve to convert electrical energy applied by the electrodes to the ribbon to resistance heat for heating the dye in the dye bearing layer.

The invention will be more readily understood from the following detailed description taken with the accompanying drawings and claims.

It is noted that the drawings are not to scale, some portions being shown exaggerated to make the drawings easier to understand.

DETAILED DESCRIPTION

Figure 1:
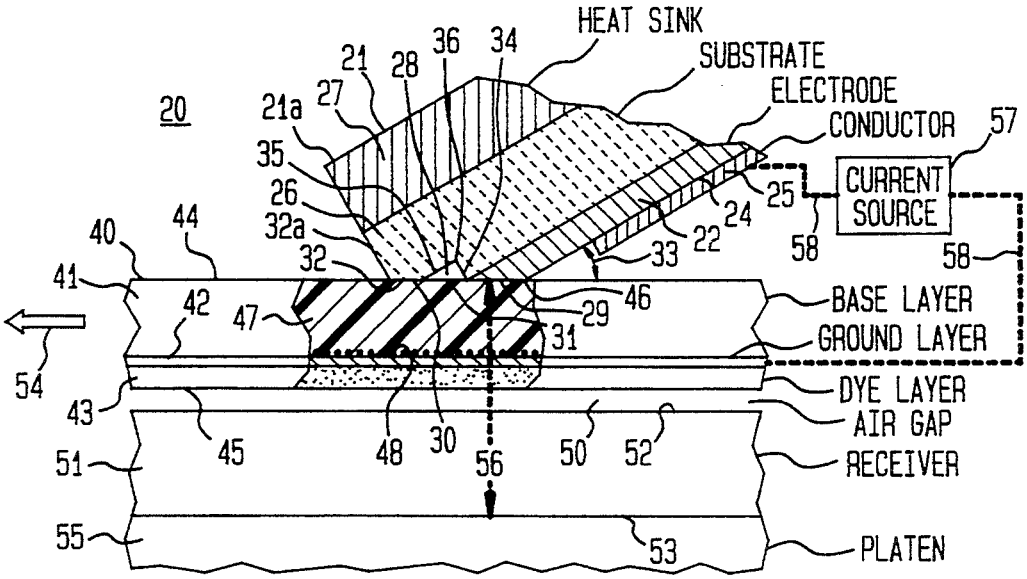
FIG. 1 is a schematic partial sectional side view of a print head and resistive ribbon arrangement in accordance with an embodiment of the invention.
Figure 2:
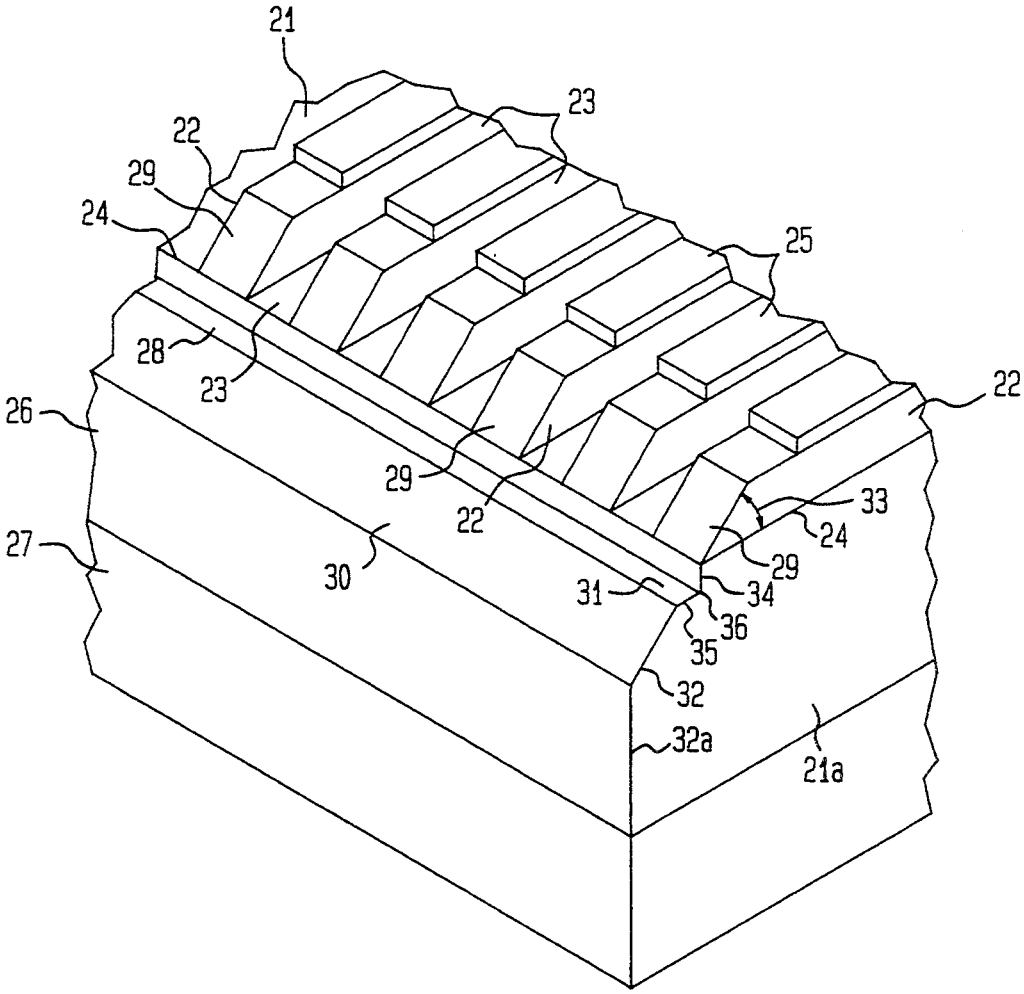
FIG. 2 is a schematic perspective inverted view showing the various parts, including the groove and exposed end faces of the electrodes and substrate, of the print head shown in FIG. 1.

Referring now to FIGS. 1 and 2, there is shown a printing arrangement 20 for resistive ribbon thermal printing in accordance with an embodiment of the present invention.

Arrangement 20 comprises a print head 21, a print head end 21*a*, electrodes 22, interspaces 23, an electrode plane 24, conductors (leads) 25, a substrate 26, a heat sink 27, a groove (notch) 28, electrode end faces 29, a substrate end face 30, a groove entrance 31, a contact plane 32, an end plane 32*a*, an angle 33 (indicated by a double arrow), a ribbon 40, a base layer 41, a ground layer 42, a dye layer 43, a contact surface 44, a transfer surface 45, a contact interface 46, a base layer bulk 47, an oxide layer 48, an air gap 50, a receiver 51, a receiving surface 52, a platen contacting surface 53, a moving direction 54 (indicated by an arrow), a platen 55, a compression nip 56 (indicated by a dashed arrow), a current source 57, and a circuit 58 (indicated by a dashed line).

Print head 21 comprises a linear array, i.e., a row, of side by side, closely spaced apart, electrically and thermally conductive electrodes 22, separated by interspaces 23, and lying in a common electrode plane 24. Electrodes 22 are of common polarity (i.e., all anodes or all cathodes, depending on the electrical energizing circuit arrangement), and are selectively energized by conductors (leads) 25 connected to a source of electrical energy, e.g., current pulses (not shown).

Electrodes 22 are uncoated and are normally mechanically supported by an electrically non-conductive substrate 26 connected to a heat sink 27 remote from electrodes 22. In accordance with the invention, a groove (notch) 28 is interposed between electrodes 22 and substrate 26 to space substrate 26 functionally from electrodes 22.

Electrodes 22 are formed of high hardness, electrically conductive (low electrical resistance) uniform material (i.e., of homogeneous nature throughout), such as non-oxide ceramic (refractory) material, and particularly metal carbide, metal nitride or non-metal carbide, e.g., tungsten carbide, silicon carbide, zirconium carbide, titanium carbide, titanium nitride, and the like. Electrodes 22 typically have a Vickers hardness (diamond pyramid) of at least about 1,500 Hv and thus possess high wear resistance.

Substrate 26 is formed of high hardness, electrically non-conductive (high electrical resistance, insulating) uniform material (i.e., of homogeneous nature throughout), such as ceramic (refractory) material of selective thermal conductivity, and particularly metal oxide, metal nitride, mixed metal oxide and non-metal oxide, or glass-ceramic, e.g., beryllium oxide, aluminum nitride, magnesia, alumina, magnesium aluminate, titania, calcium titanate, barium titanate, zirconia, forsterite, steatite, fotoceram, pyroceram, and the like. Substrate 26 typically has a Vickers hardness of at least about 500 Hv, such as about 500 to 1,700 Hv. Substrate 26 has a selective thermal conductivity, e.g., of at least about 2 W/m.C. (watts per meter per degree C.) to about 260 W/m.C., or higher, such as a low thermal conductivity of about 2 to below about 20, preferably about 5 to below about 20, W/m.C., as in the case of pyroceram, fotoceram, steatite, titania and alumina of 95% purity, or a high thermal conductivity of at least about 20 to about 260 W/m.C., or higher, preferably about 20 to 80 W/m.C., as in the case of alumina of at least 99% purity, magnesia and beryllium oxide, as desired.

Electrodes 22 are connected to substrate 26 in conventional manner.

Heat sink 27 is formed of heat conductive material such as aluminum, and is connected to substrate 26 remote from groove 28 and electrodes 22. Heat sink 27 is conventional and may have a finned structure to aid heat transfer (dissipation), if desired.

Electrodes 22 correspondingly terminate in exposed end faces (contact faces) 29 at the printing portion of print head 21 located at print head end 21*a*. Similarly, substrate 26 terminates in an exposed substrate end face 30 (contact face) at print head end 21*a*. Groove 28 is defined in substrate end face 30 and extends crosswise of movement direction 54, having a groove entrance 31. The row of electrodes 22 in electrode plane 24 and the substrate 26 are in abutment in succession in movement direction 54. Groove 28 is interposed to define a boundary therebetween thermally separating electrodes 22 from substrate 26 at their corresponding end faces. The row of electrode end faces 29, plus groove entrance 31 and substrate end face 30, lie in succession in movement direction 54 in a common contact plane 32 which extends at an acute contact angle 33, e.g., of about 30 to 45 degrees, to electrode plane 24.

Electrode end faces 29 and substrate end face 30 in contact plane 32 are arranged for sliding pressure contact with ribbon 40. The remote end portion of substrate 26 lies in a print head recessed end plane 32*a* generally normal to electrode plane 24 and at an obtuse angle to contact plane 32, at print head end 21*a*.

Resistive ribbon 40 is conventional, e.g., with an upper electrically resistive base (supporting substrate) layer 41, an intermediate electrically resistive ground layer 42 as explained below, and a lower heat transferable dye bearing layer 43. Base layer 41 defines upper contact surface 44 and dye layer 43 defines lower transfer surface 45.

Contact surface 44 forms a contact interface 46 with print head 21 providing a contact electrical resistance at electrode end faces 29.

Base layer 41, whose exposed surface defines contact surface 44, has an electrically resistive bulk 47 providing a bulk electrical resistance. Base layer 41 may be a heat-resistant polymer layer in which bulk 47 is a carbon particle loaded polymer such as polycarbonate, with a softening or melting point above the dye transfer temperature.

Ground layer 42 is coated with an oxide layer 48 (shown schematically in FIG. 1), forming an interface electrical resistance. Ground layer 42 preferably is aluminum, such that the oxide layer 48 which grows thereon (upon attack by air) is electrically resistive aluminum oxide. Ground layer 42 may also be copper, gold, graphite, and the like.

Dye layer 43 comprises dye heatable to a given transfer temperature for transfer across air gap 50 from transfer surface 45 of ribbon 40 to receiver 51 at its facing image receiving upper surface 52. Receiver 51 underlies ribbon 40 remote from contact surface 44 and print head 21 and has an opposed platen contacting lower surface 53 to support receiver 51 on a platen 55 in known manner. Platen 55 may be of flat or cylindrical support surface type. Print head 21 forms a compression nip 56 with platen 55 under sufficient force for efficient compliant pressure contact of electrode end faces 29 and substrate end face 30 in contact plane 32, with the facing contact surface 44 of ribbon 40.

The operating temperature is determined by the dye transfer temperature, i.e., the temperature at which the dye melts or sublimes for flowable transfer from dye layer 43 across air gap 50 to receiving surface 52 of receiver 51. Air gap 50 is defined by the roughness of receiving surface 52, e.g., when plain (uncoated) paper, traceable to the rough surface character of paper.

Air gap 50 is normally present if a sublimable dye is used (sublimation transfer mechanism). If a meltable, e.g., wax based, dye is used (melt diffusion transfer mechanism), air gap 50 may be omitted. This is usually the case when receiver 51 has a receiving coating, e.g., of polymer material on a paper substrate, or is itself formed of a polymer film, e.g., a transparent polymer film, such that receiving surface 52 is smooth and even (ideal receiver), essentially eliminating air gap 50. However, it is known to embed protruding fine particles (beads) in the polymer surface defining receiving surface 52 to form air gap 50, if sublimable dye is used.

The dye transfer temperature depends on the dye and its mode of transfer, e.g., by melt diffusion or by sublimation, and on the material nature and degree of roughness of receiving surface 52. The operating temperature is usually about 250 to 500 degrees C.

Typically, the thickness of base layer 41 is about 15 microns (about 0.0006 inch), and that of ground layer 42 is about 0.1 micron (about 0.000003937 inch). If receiver 51 is plain paper, dye layer 43 has a greater thickness, e.g., of about 4 microns (about 0.000157 inch), to assure localized transfer of sufficient dye to cover the rough receiving surface 52. If receiver 51 has a polymer coating or is itself a polymer film, dye layer 43 has a lesser thickness, e.g., of about 0.5 micron (0.0000196 inch), as less dye is needed to cover the (ideal) receiving surface 52.

Print head 21 selectively applies electrical energy (current pulses) via selective individual electrode end faces 29 to contact surface 44 of ribbon 40, during sliding pressure contact and relative movement therebetween in movement direction 54, for selective resistive heating of the dye in dye layer 43 for transfer from ribbon 40 to receiver 51 to form dye images on receiving surface 52, under control of known control means, e.g., having a programmed microprocessor (not shown), in conventional manner. The electrical energy supplied to ribbon 40 generates resistive heat at contact interface 46 (at electrode end faces 29), in bulk 47 and at oxide layer 48.

Current return occurs by travel through ground layer 42 to a reference potential, e.g., ground, by known means (not shown) at a point in ground layer 42 remote from electrodes 22, i.e., spaced in movement direction 54 from that at which print head 21 contacts ribbon 40 at contact interface 46.

Thus, in conventional manner, energizing current from a source 57 passes via conductors 25 and electrodes 22 to ribbon 40 and returns via ground layer 42 and the ground to the current source 57 to complete an energizing circuit 58 containing said control means, e.g., having a programmed microprocessor (not shown).

The arrangement of ribbon 40 and receiver 51 may be regarded as constituting a system of six individual layers, three of which carry current (resistance layers) and all six of which conduct heat.

The three current carrying layers are (1) the contact resistance layer defined by contact interface 46 (contact resistance) which exists between the current supplying electrodes 22 and the polymer support layer defined by base layer 41 of ribbon 40, (2) the polymer support layer defined by base layer bulk 47 (bulk resistance) of base layer 41, and (3) ground layer 42, e.g., of metal such as aluminum, on which oxide layer 48 (interface resistance) is disposed. Generally, oxide layer 48 grows as an oxide film on ground layer 42 which serves as the electrical ground of the system, the oxide film being particularly significant, if not crucial in the case of a metal ground layer, for producing a desired high electrical resistance in the current flow path immediately adjacent dye layer 43, which results in high (locally intense) heating very close to the dye.

The remaining three layers are (4) dye layer 43, (5) the gap defined by air gap 50, to the extent that it exists in the system, e.g., across which dye sublimation occurs, and (6) the receiver layer defined by receiver 51.

FIG. 1 shows ribbon 40 and receiver 51 as moving in movement direction 54, and print head 21 as stationary. However, print head 21 may move in the opposite direction while ribbon 40 and receiver 51 are stationary. Such relative movement occurs in known manner.

Base layer 41 and ground layer 43 convert electrical energy applied by electrodes 22 to ribbon 40 at contact interface 46 to resistance heat that heats the dye in dye layer 43 to a given dye transfer temperature. However, some of this generated resistance heat is transferred to electrodes 22, which are designed to operate as electrical conductors, rather than as heat generating resistors, and also to substrate 26, as both electrode end faces 29 and substrate end face 30 are in sliding pressure contact with ribbon 40.

Heat transfer from ribbon 40 to electrodes 22, and therefrom to substrate 26, and also from ribbon 40 directly to substrate 26, and in turn to heat sink 27, may be controlled by using a substrate 26 of low thermal conductivity, e.g., about 2 to below about 20 W/m.C. However, the speed of printing is limited in this case since electrodes 22 (probes) overheat at higher print speeds due to excess energy input.

As heat is transferred at substrate end face 30 immediately after electrode end faces 29 have traversed a given point in ribbon 40, cooling of the heated dye volume (mass) in dye layer 43 occurs thereat, which accordingly reduces the desired amount of dye above the critical transfer temperature required for transfer to receiver 51 as image pixels.

For this reason, groove 28 is provided according to the invention. Groove 28 has a groove entrance 31 with a selective width between the row of electrodes 22 and substrate 26. This width is selected to be sufficient to inhibit heat transfer at groove 28 from ribbon contact surface 44 to substrate end face 30 for controlling the amount of dye heated to the transfer temperature adjacent groove 28 during relative movement between print head 21 and ribbon 40. This in turn controls the pixel size of the dye images formed on receiver 51.

The width of groove entrance 31 is at least about 20 microns (0.0008 inch), and is typically about 20 to 50 microns (0.0008 to 0.002 inch). Groove 28 is favorably a shallow groove whose depth need only be sufficient to space ribbon contact surface 44 from substrate 26 thereat to interrupt contact between substrate end face 30 and contact surface 44 to prevent heat transfer thereat. The depth of groove 28 is typically at least about 10 microns (0.0004 inch) inwardly from groove entrance For maximum heat conservation, i.e., to minimize heat transfer to substrate 26 directly from ribbon 40, substrate 26 desirably has a low thermal conductivity, e.g., about 2 to below about 20 W/m.C. If rapid heat drain from ribbon 40 is required, i.e., by higher rate heat transfer from electrodes 22 to substrate 26, and from ribbon 40 directly to substrate 26 after ribbon 40 has traversed groove 28, substrate 26 is desirably of high thermal conductivity e.g., about 20 to 260 W/m.C., or higher, preferably about 20 to 80 W/m.C.

Electrode end faces 29 and substrate end face 30 are desirably polished to a highly smooth finish for maximum contact of these exposed (uncoated) end faces with contact surface 44 of ribbon 40 at contact interface 46. As electrode end faces 29 precede substrate end face 30 and thus contact ribbon 40 before substrate end face 30 contacts ribbon 40, during relative movement between print head 21 and ribbon 40, electrode end faces 29 serve to iron ribbon 40 at its contact surface 44, under the applied sliding pressure at compression nip 56.

Figure 4:
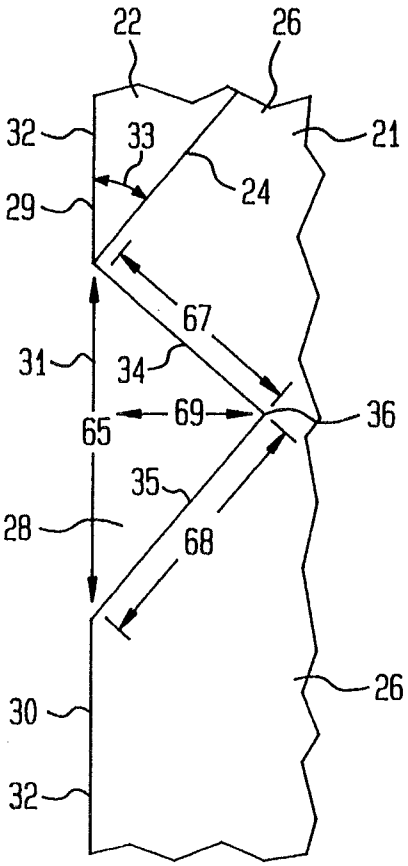
FIG. 4 is an enlarged schematic side view of a portion of the electrodes and substrate shown in FIG. 3.
Figure 3:
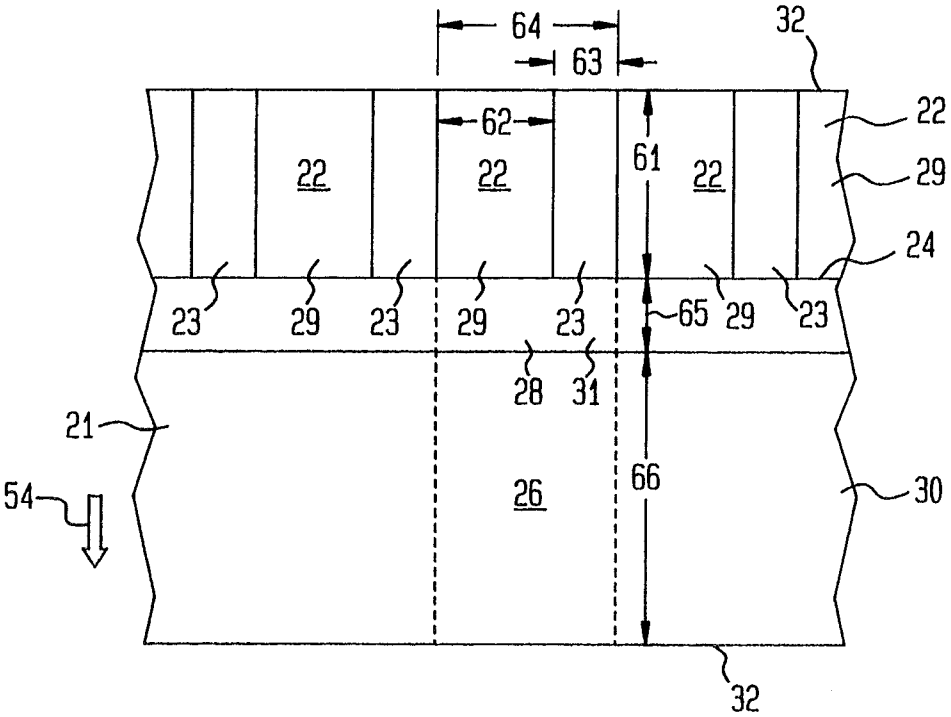
FIG. 3 is a schematic flat projection view of a portion of the electrodes, groove and substrate, as shown in FIG. 2.

Referring now to FIGS. 3 and 4, a flat projection view and a side view, respectively, are shown of a portion of electrodes 22, groove 28 and substrate 26, of FIG. 2.

FIGS. 3 and 4 show, as the case may be, print head 21, electrodes 22, interspaces 23, electrode plane 24, substrate 26, groove 28, electrode end faces 29, substrate end face 30, groove entrance 31, contact plane 32 and angle 33, plus dimensions 61 to 69 (D1 to D9). FIG. 4 also shows a groove first side 34 adjacent electrode end faces 29, a groove second side 35 adjacent substrate end face 30, and a groove bottom 36, e.g., forming a right angle apex between first side 34 and second side 35 of groove 28.

The dimensions (D) include an electrode end face height (length) 61 (D1) in movement direction 54, an electrode end face width 62 (D2) transverse to movement direction 54, an interspace width 63 (D3) between adjacent electrodes 22, an electrode pitch 64 (D4), a groove entrance width (hypothenuse) 65 (D5) in movement direction 54, a substrate end face height 66 (D6) in movement direction 54, a groove first side length 67 (D7), a groove second side length 68 (D8), and a groove depth 69 (D9) perpendicular to groove entrance width (hypothenuse) 65 (D5).

In one illustrative embodiment, for a print head 21 with a resolution of 300 dpi (dots per inch), electrode end faces 29 have a square shape with a 42.3 micron height 61 (D1) in movement direction 54, and a 42.3 micron width 62 (D2) in a direction transverse thereto, and interspaces 23 have a 42.3 micron width 63 (D3) between electrode end faces 29. The pitch 64 (D4) of the 300 dpi electrodes 22 is 3.33 mils, i.e., 0.00333 inch (1/300), or 84.6 microns. The pitch is the center to center distance between electrodes 22, or stated another way is the sum of the 42.3 micron width 62 (D2) of an electrode end face 29 and the 42.3 micron width 63 (D3) of an adjacent interspace 23.

Use of electrode end faces 29 of square shape will generally produce good (favorable) quality text (character) images such as when end face width 62 (D2) equals interspace width 63 (D3). As end face width 62 (D2) increases and interspace width 63 (D3) decreases for the given 300 dpi resolution and pitch 64 (D4), end face height 61 (D1) should also decrease to keep constant the end face contact area, while changing the end face to oblong rectangular shape, i.e., with end face width 62 (D2) as its major dimension. Use of electrode end faces 29 of oblong rectangular shape will generally produce good (favorable) quality picture (graphic) images. Maintaining a constant electrode end face contact area provides a constant current density for electrodes 22 (i.e., a constant power consumption for the printer).

The end face contact area roughly determines the pixel size of the transferred dye "dots" that form images on receiving surface 52 of receiver 51. Pixel overlap in the width direction transverse to movement direction 54 is achieved by increasing end face width 62 (D2) and decreasing interspace width 63 (D3). Depending on the desired degree of pixel overlap, per increasing end face width 62 (D2) and decreasing interspace width 63 (D3), end face height 61 (D1) can be decreased to form such an oblong shape end face of the same contact area as the square end face. This permits favorable quality picture images to be obtained with increasing pixel overlap while keeping the same end face contact area (constant current density) as with the square end face (that produces favorable quality text images).

For a 300 dpi print head 21 with a constant electrode end face area, end face height 61 (D1) may be about 42.3 to 29.8 microns, and concordantly end face width 62 (D2) may be about 42.3 to 60 microns and interspace width 63 (D3) may be about 42.3 to 24.6 microns. For a square end face with a 42.3 micron end face height 61 (D1) and width 62 (D2), the electrode end face area is 1789 square microns (42.3×42.3), and interspace width 63 (D3) is 42.3 microns. For such an oblong shaped end face with a 29.8 micron end face height 61 (D1) and 60 micron end face width 62 (D2), the electrode end face area is 1788 square microns (29.8×60), and interspace width 63 (D3) is 24.6 microns.

Groove entrance width 65 (D5) is typically at least about 20 microns (about 0.0008 inch), and generally is in the range of about 20 to 50 microns (about 0.0008 to 0.002 inch), and groove depth 69 (D9) is typically at least about 10 microns (about 0.0004 inch).

Groove 28 is conveniently formed in substrate 26 at its margin adjacent the corresponding facing margins of the row of electrodes 22 in abutment therewith, by a grinding wheel in conventional manner (not shown), e.g., with the rotational axis of the wheel at an angle to substrate end face 30. This forms groove first side 34 parallel to the wheel axis and groove second side 35 at right angles thereto, thereby providing groove bottom 36 as a right angle apex between groove first side 34 and groove second side 35. The angle and depth of the grinding wheel cut determine the hypothenuse value of groove entrance width 65 (D5) and the value of groove depth 69 (D9) extending perpendicular to the hypothenuse defined by groove entrance 31. Groove entrance 31 forms an isolating boundary between the row of electrodes 22 and substrate 26 at the facing margins of electrode end faces 29 and substrate end face 30.

Groove 28 may be formed in any desired manner and of any given shape. Groove entrance width 65 (D5) determines the extent of interruption of the contact between print head 21 and ribbon 40 at contact interface 46 during relative movement therebetween. Groove depth 69 (D9) need only be sufficient to prevent heat transfer from ribbon 40 to substrate 26 at groove entrance 31.

A constant electrode end face area, providing a constant current density, is desired, regardless of the shape of electrode end faces 29. This area plus the area of substrate end face 30 forms the total contact area of print head 21 in contact with contact surface 44 of ribbon 40. Print head 21 is applied against ribbon 40 at a high force for compliant contact therebetween during relative movement thereof. This force is distributed over the total contact area, typically exerting a pressure of about 225 psi at compression nip 56.

For this reason, metal electrodes are not appropriate according to the invention since they possess insufficient hardness and undergo accelerated wear under the contemplated operating conditions, e.g., at a temperature of about 250 to 500 degrees C. and a pressure of about 225 psi at compression nip 56. Instead, according to the invention, electrodes 22 are formed of appropriate long-wearing refractory material, i.e., are formed of a heat-resistant electrically conductive nonoxide ceramic material, e.g., having a Vickers hardness of at least about 1,500 Hv.

The dimension of groove entrance width 65 (D5) is small relative to the typical substrate end face height 66 (D6) in movement direction 54. Thus, for a given transverse width of substrate end face 30 in a direction transverse to movement direction 54 and a given collective contact area of electrode end faces 29, the decrease in contact area of substrate end face 30 and concordant increase in total contact pressure above about 225 psi caused by the presence of groove 28 are not significant compared to the pixel size control achieved with groove 28.

Other things being equal, it is known that if the substrate is recessed relative to the electrodes so that no substrate end face (contact face) is exposed, i.e., for contact with the resistive ribbon, this force is concentrated at the electrode end faces, exerting a much higher pressure than 225 psi, typically about 2,000 psi, on the ribbon. Modifying the print head to provide the substrate with an exposed end face (contact face), i.e., lying in the contact plane of the electrode end faces, increases the area of contact with the ribbon and reduces the contact pressure under the same such force, typically to about 225 psi. Thus, for an equivalent force, use of an exposed substrate end face (contact face) increases the total contact area of the print head and reduces the contact pressure on the ribbon in direct proportion to the increase in contact area.

However, use of a print head with an exposed thermally conductive substrate end face (contact face) has a negative impact on printing efficiency. This is because the hot ribbon, as it emerges from underneath the exposed end faces of the current supplying electrodes, immediately contacts the exposed substrate end face which functions as a heat transferring surface. This causes heat transfer from the ribbon to the substrate, rapidly cooling the dye in the ribbon, such that the volume amount of dye raised to a level above the temperature critical for dye transfer is greatly reduced.

The provision for groove 28 immediately adjacent the row of electrodes 22, according to the invention, compensates for this inefficiency by reducing heat transfer from ribbon 40 to print head 21. The width 65 (D5) of groove entrance 31, in effect, determines the volume amount of dye elevated to above the critical dye transfer temperature in ribbon 40. The slight reduction in the total contact area of print head 21 and concordant undesired increase in contact pressure, consonant inclusion of groove 28 in substrate 26, is more than offset according to the invention, in that groove 28 prevents the drop in printing efficiency otherwise caused by heat transfer from ribbon 40 to substrate end face 30.

While end face width 62 (D2) and interspace width 63 (D3) are determined by the, e.g., 300, dpi resolution of print head 21, end face height 61 (D1) is determined by angle 33, preferably of about 30 to 45 degrees. Too large an angle 33 (above 45 degrees) causes wrinkling and damage of ribbon 40, under the contact pressure, and unduly decreases and thus limits electrode end face height 61 (D1) and the electrode end face area for a given electrode end face width 62 (D2). Too small an angle 33 (below 30 degrees) unduly increases electrode end face height 61 (D1) and the electrode end face area for a given electrode end face width 62 (D2), and increases contact friction.

Thus, for a given pitch 64 (D4), end face width 62 (D2) determines interspace width 63 (D3), the pixel width dimension in a direction transverse to movement direction 54, and the degree, if any, of pixel width overlap as end face width 62 (D2) increases and interspace width 63 (D3) decreases. Angle 33 determines end face height 61 (D1), which decreases as angle 33 increases. For a given end face width 62 (D2), angle 33 also determines whether electrode end faces 29 are square or oblong in shape. The energizing pulsing conditions and speed of relative movement between print head 21 and ribbon 40, plus angle 33, determine the pixel height dimension and any pixel overlap in movement direction 54.

Table 1 shows typical electrically conductive nonoxide ceramic refractory materials usable for electrodes 22, and their individual electrical (volume) resistivity (microhm-cm) and Vickers hardness (kg/sq mm) values.

TABLE 1

| | Electrodes | |
|---|---|---|
| | Electrical Resistivity microhm-cm | Vickers Hardness kg/mm$^2$ |
| Tungsten Carbide (WC) | 20 | 1600–2200 |
| Silicon Carbide (SiC) | 150 | 4000 |
| Zirconium Carbide (ZrC) | 70 | 2600 |
| Titanium Carbide (TiC) | 105 | 2500 |
| Titanium Nitride (TiN) | 22 | 4000 |

It is seen from Table 1 that these electrode ceramic refractory materials all have low electrical resistivity (high electrical conductivity) and high hardness levels.

Table 2 shows typical electrically non-conductive ceramic refractory materials of high thermal conductivity usable for substrate 26, and their individual high thermal conductivity (W/m.C.) (in descending order) and Vickers hardness (kg/sq mm) values.

TABLE 2

| | Substrate | |
|---|---|---|
| | Thermal Conductivity W/m.C | Vickers Hardness kg/mm$^2$ |
| Beryllium Oxide (Beo) | 258.0 | 1200 |
| Aluminum Nitride (AlN) | 170.0 | 1200 |
| Magnesia (MgO) | 60.5 | 700 |
| Alumina ($Al_2O_3$ 99.5%) | 25.1 | 1700 |
| Alumina ($Al_2O_3$ 99.0%) | 25.1 | 1650 |

It is seen from Table 2 that these ceramic refractory materials usable for the substrate all have high hardness levels. As electrical insulators, they also have high electrical resistivity values, such being equal to or greater than $1\times10^{14}$ microhm-cm for all the listed materials.

Table 3 shows typical electrically non-conductive ceramic refractory materials of low thermal conductivity usable for substrate 26, and their individual low thermal conductivity (W/m.C.) (in descending order) and Vickers hardness (kg/sq mm) values.

TABLE 3

| | Substrate | |
|---|---|---|
| | Thermal Conductivity W/m.C | Vickers Hardnpss kg/mm$^2$ |
| Alumina ($Al_2O_3$ 95.0%) | 16.0 | 1000 |
| Magnesium Aluminate ($MgO.Al_2O_3$) | 13.8 | 1100 |
| Titania ($TiO_2$) | 5.4 | 780 |
| Calcium Titanate ($CaTiO_3$) | 5.3 | 880 |
| Barium Titanate ($BaTiO_3$) | 4.2 | 880 |
| Zirconia ($ZrO_2$) | 3.8 | 1200 |
| Forsterite ($2MgO.SiO_2$) | 3.8 | 800 |
| Steatite ($MgO.SiO_2$) | 3.0 | 550 |
| Fotoceram | 2.6 | 540 |
| Pyroceram | 2 | 700 |

It is seen from Table 3 that these ceramic refractory materials usable for the substrate all have acceptable hardness levels. As electrical insulators, they all have high electrical resistivity values, such being equal to or greater than $1\times109$ microhm-cm for all the listed materials.

It is noted that the thermal conductivity of alumina increases with its increasing purity.

For optimum electric current conduction from electrodes 22 to ribbon 40, the hardness and wear resistance of substrate 26 should be lower than the hardness and wear resistance of electrodes 22 to prevent recession (wear) of electrode end faces 29 below substrate end face 30 at contact plane 32 during sliding pressure contact thereof with ribbon 40. Thus, the electrode material desirably possesses higher wear resistance than the substrate material.

Figure 5:
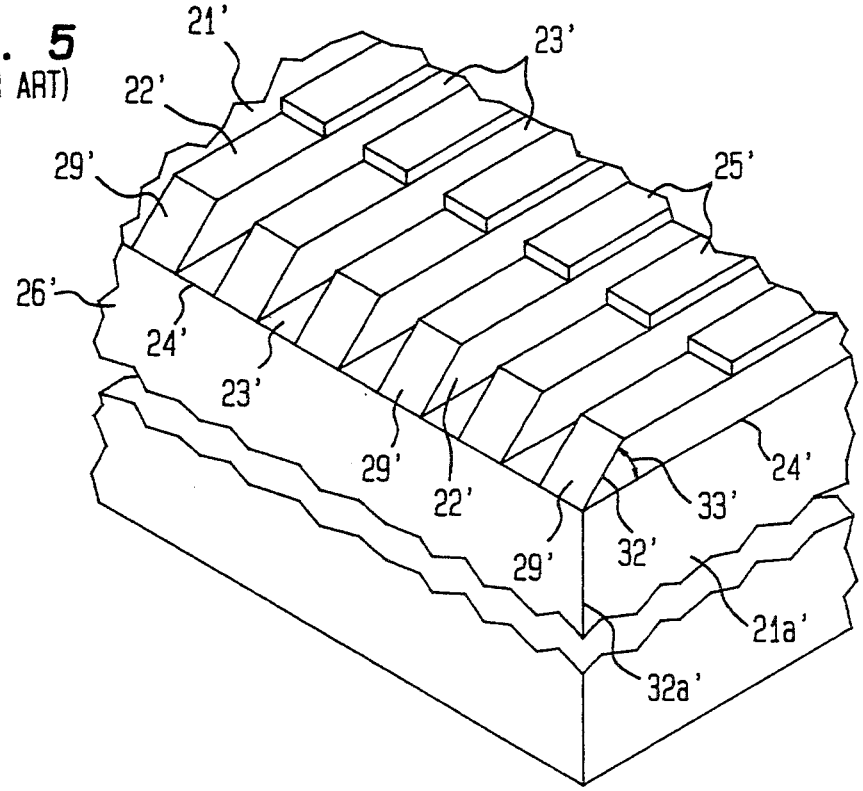
FIG. 5 (PRIOR ART)
FIG. 5 is a view similar to FIG. 2, showing a prior art print head having electrodes with exposed end faces and a substrate having no exposed end face.

Referring now to FIG. 5, a prior art print head 21' is shown in perspective inverted view which is similar to print head 21 of FIG. 2, with the same parts, designated by prime (') reference numerals, except that substrate 26' has no exposed end face at print head end 21a', i.e., for making sliding contact with the resistive ribbon, and groove 28 according to the invention is absent. Electrodes 22' are spaced by interspaces 23', lie in electrode plane 24' for energizing by conductors 25', and are supported on substrate 26' whose recessed (remote) end face lies in print head end plane 32a'. A heat sink (not shown) is connected to the remote side of substrate 26'. Electrode end faces 29' lying in contact plane 32' analogously form an acute angle 33' with electrode plane 24'. In this case, the contact pressure is transmitted to the ribbon (not shown) via the limited collective area of electrode end faces 29' at a force of typically about 2,000 psi, which exposes the ribbon to damage under the heat conditions.

Figure 6:
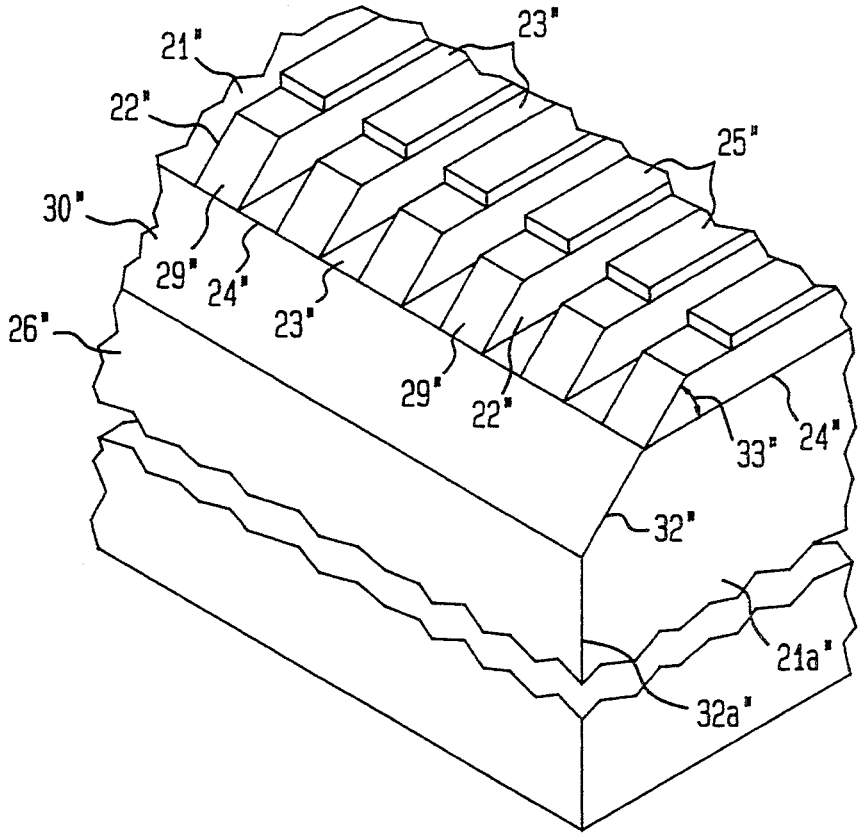
FIG. 6 is a view, similar to FIG. 2, showing a comparison print head having electrodes and a substrate with exposed end faces, but without the groove of the present invention.

Referring now to FIG. 6, a comparison print head 21" is shown in perspective inverted view which is similar to print head 21 of FIG. 2, with the same parts, designated by double prime (") reference numerals, except that groove 28 according to the invention is absent. Electrodes 22" are spaced by interspaces 23", lie in electrode plane 24" for energizing by conductors 25", and are supported on substrate 26". A heat sink (not shown) is connected to the remote side of substrate 26". Electrode end faces 29" and substrate end face 30" lying in contact plane 32" at print head end 21a" analogously form an acute angle 33" with electrode plane 24" remote from print head end plane 32a". In this case, the contact pressure is transmitted to the ribbon (not shown) via the larger collective area of electrode end faces 29" and substrate end face 30" at a force of typically about 225 psi, avoiding damage to the ribbon under the heat conditions.

Figure 7:
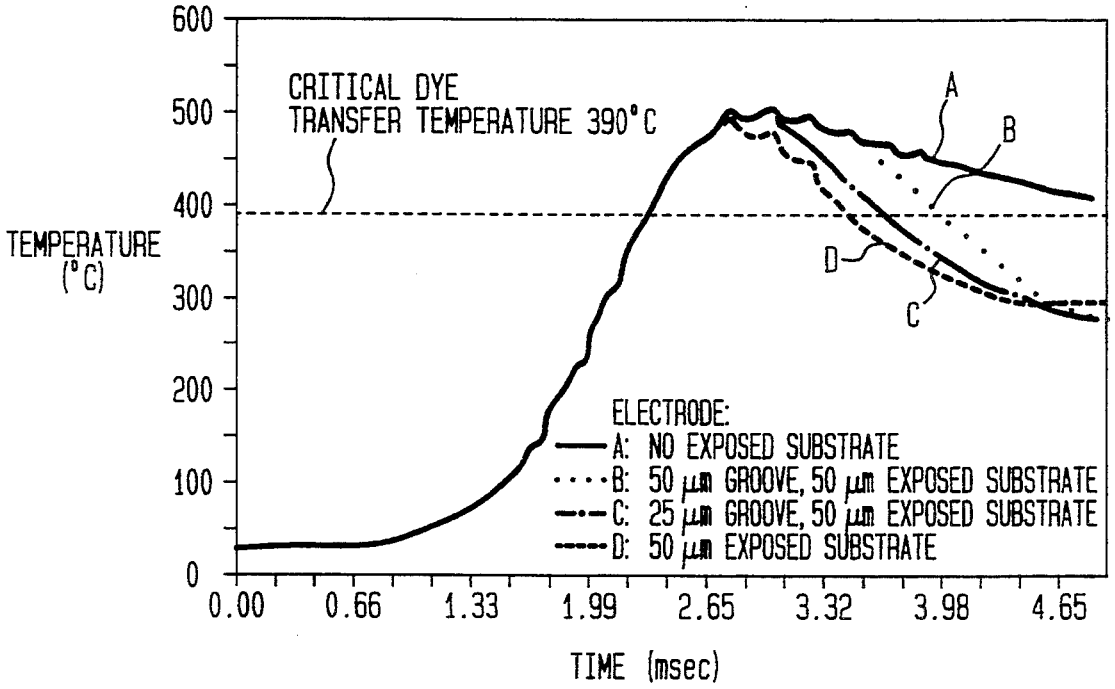
FIG. 7 is a graph showing the calculated effect in a thermal model of the groove on the temperature profile of a point in the dye layer of the resistive ribbon as it traverses the electrodes as a function of time for a fixed travel speed.

Referring now to FIG. 7, a graph is set forth illustrating calculations of the effect in a thermal model of the groove of the invention on the temperature profile of a point in the dye layer of the ribbon as it traverses the electrodes, together with the receiver, as a function of time for a fixed (constant) speed of travel of the ribbon and receiver past a stationary print head having a high thermal conductivity substrate.

The graph shows the predicted temperature (ordinate) in degrees C. of a point in the dye, having a critical dye transfer temperature of 390 degrees C., at the interface of the ground layer and dye layer, over time (abscissa) in milliseconds (msec) of ribbon travel at constant speed, for four different cases:

A: where substrate 26' has no exposed end face (contact face) per prior art FIG. 5;

B: where substrate 26 has a 50 micron (0,002 inch) groove entrance width 65 (D5) and a 50 micron (0,002 inch) substrate height 66 (D6) per invention FIGS. 1 to 4;

C: where substrate 26 has a 25 micron (0,001 inch) groove entrance width 65 (D5) and a 50 micron (0.002 inch) substrate height 66 (D6) per invention FIGS. 1 to 4; and D: where substrate 26'' has an exposed end face 30'' (contact face) per comparison FIG. 6.

The calculation was based on a thermal model of the printing system operated at D-max (maximum optical density achievable), under PCM (pulse count modulation) at 256 energizing pulses per line, 56% duty (ratio of pulse on-time to off-time), 6 microsecond pulse period, at a ribbon (and receiver) travel speed of 5.65 cm per sec., and at a current of 45 mA and voltage of 9 V. The substrate/electrode heat transfer coefficient (h) was taken as 40 W/sq cm. C. (watts per square centimeter per degree C.).

The thermal model constituted a three dimensional, transient, coupled thermal-electric model for the resistive ribbon/receiver structure, which was developed using the commercially available ANSYS finite element software. The numerical model predicts the instantaneous current density, the voltage and the transient temperature distributions in the multi-layer ribbon/-receiver structure for a pulsed current input from an electrode, in which there is relative movement between the ribbon/receiver structure and the electrode, thereby emulating the arrangement of FIGS. 1 and 2. The model contemplates sublimation transfer of a sublimable dye across an air gap from the ribbon to the receiver.

In accordance with FIG. 1, the ribbon/receiver model has six layers, three of which carry current and all six of which conduct heat. All six layers are characterized by their thickness, thermal conductivity, specific heat and density, while the three current conducting layers each have an electrical resistivity. These resistivities can be derived using the model from experimental resistance measurements on the ribbon structure.

As earlier noted, the three resistance layers are: (1) the contact resistance layer which exists between the given current applying electrode and the polymer support layer of the ribbon, (2) the polymer support layer, and (3) the ground layer, in this case taken as an aluminum ground layer, i.e., on which an oxide film grows and which is generally crucial to producing a high resistance in the current flow path, resulting in high heating very close to the dye. This aluminum ground layer is the electrical ground of the system. The three remaining layers, which are thermally conducting but not electrically conducting, are: (4) the dye layer, (5) an air gap, across which dye sublimation occurs, and (6) the receiver layer.

The model assumes current flow into the ribbon across an area under (in sliding pressure contact with) a given electrode. A PCM (pulse count modulation) scheme is used for current input, and it is characterized by its stated pulse period and duty cycle (i.e., the percentage of the energizing pulse "on" to "off" time). The printing line time is equal to the number of pulses required to achieve maximum optical density (in this case 256 pulses per line) times the pulse period (in this case about 6 microseconds). A fraction of the heat generated in the ribbon can flow back into the electrode; this heat flux can be quite large. Prescribed heat flux or temperature boundary conditions in the model allow consideration of multiple electrode firing combinations, for example, every electrode, or every second or third, etc. electrode, firing simultaneously. In the results presented, only the case of all electrodes firing at the same time has been considered. Heat convection from the ribbon surface is also included in the model.

The model output includes the magnitude and direction of the instantaneous current density vector, the voltage distribution in the three electrically conductive layers, and the temperature distribution in the full structure. The model is used to study the impact of the numerous input parameters, particularly on the transient temperature distribution in the dye layer.

Moreover, the ribbon/receiver cross sectional temperature distributions shown in FIGS. 8A, 8B and 8C, treated hereinafter, are those derived in the thermal model as occurring after the printing process has been printing at the maximum number of pulses per printed line such that the ribbon/receiver structure will have this "steady state" temperature "swept" through it as the page (receiver) is printed. This is a special case, however, since an actual image is made up of a full spectrum of optical densities. Of course, any combination of densities can be modelled in connection with the carrying out of the invention, but for clarity have not been presented.

It is seen from FIG. 7 that the maximum temperature reached at the interface of the ground layer and dye layer in the ribbon slightly exceeds 500 degrees C., during the total printing time (abscissa) which corresponds to the printing of about four lines of pixel images.

Initially, per case A, a print head per prior art FIG. 5 having a high thermal conductivity substrate with no exposed substrate end face in contact with the ribbon, thus having an electrode end face contact area formed of electrodes of 0.0013 inch (33 micron) end face width D2 and 0.002 inch (50 micron) end face height D1, was used for actual printing tests, and achieved a maximum optical density of 2.2 under given electrical pulsing and contact force conditions.

Then, per case D, the print head was modified to provide the high thermal conductivity substrate with an exposed substrate end face (contact face) to bring a contact area of 0.0015 inch (38 microns) by 0.007 inch (175 microns) into contact with the ribbon, per comparison FIG. 6. This included an additional area having a substrate height D6 of 0.005 inch (125 microns). The maximum optical density obtained in actual printing tests, using similar electrical pulsing and contact force conditions, was 1.0.

When a groove (notch), per case C of the invention, was cut into the end face of the high thermal conductivity substrate immediately adjacent the row of electrodes, having a 0.001 inch (25 micron) groove entrance width D5 and a selective groove depth D9, per invention FIGS. 1 to 4, actual printing tests with the grooved print head produced an optical density of 2.0 under similar electrical pulsing and contact force conditions.

For case B of the invention, a groove (notch) is cut into the end face of the substrate of a like print head per case D, immediately adjacent the row of electrodes, having a 0.002 inch (50 micron) groove entrance width D5 and a selective groove depth D9, per invention FIGS. 1 to 4.

Figure 8A:
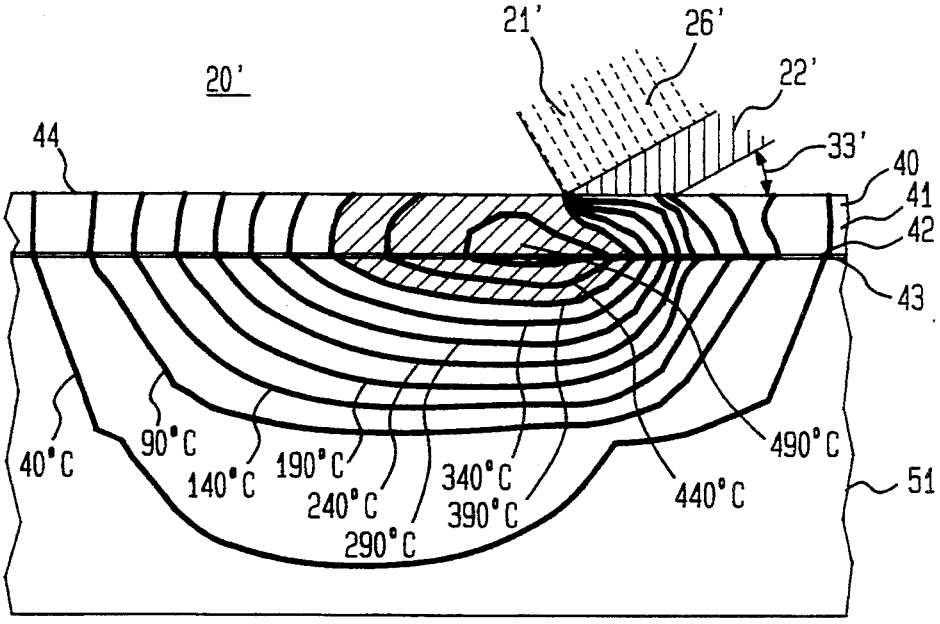
FIG. 8A is a schematic sectional side view showing the calculated size of the dye zone in the resistive ribbon that is above a critical transfer temperature, per FIG. 7, when the substrate has no exposed end face, using an arrangement with the prior art print head of FIG. 5.
Figure 8B:
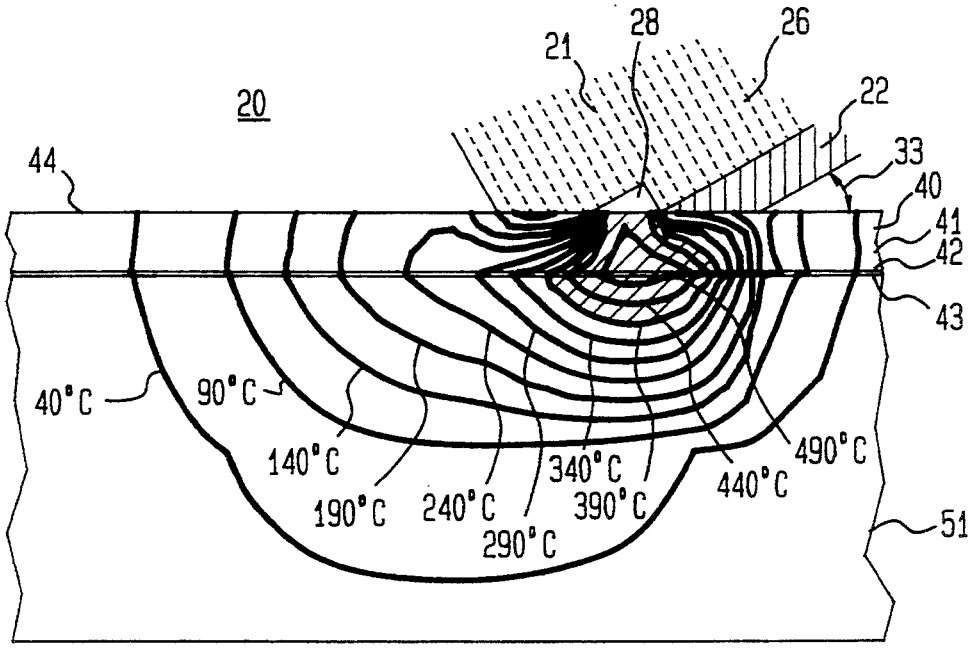
FIG. 8B is a schematic sectional side view showing the calculated size of the dye zone in the resistive ribbon that is above a critical dye transfer temperature, per FIG. 7, using an arrangement with the print head of FIG. 2 having a relatively wide groove width.
Figure 8C:
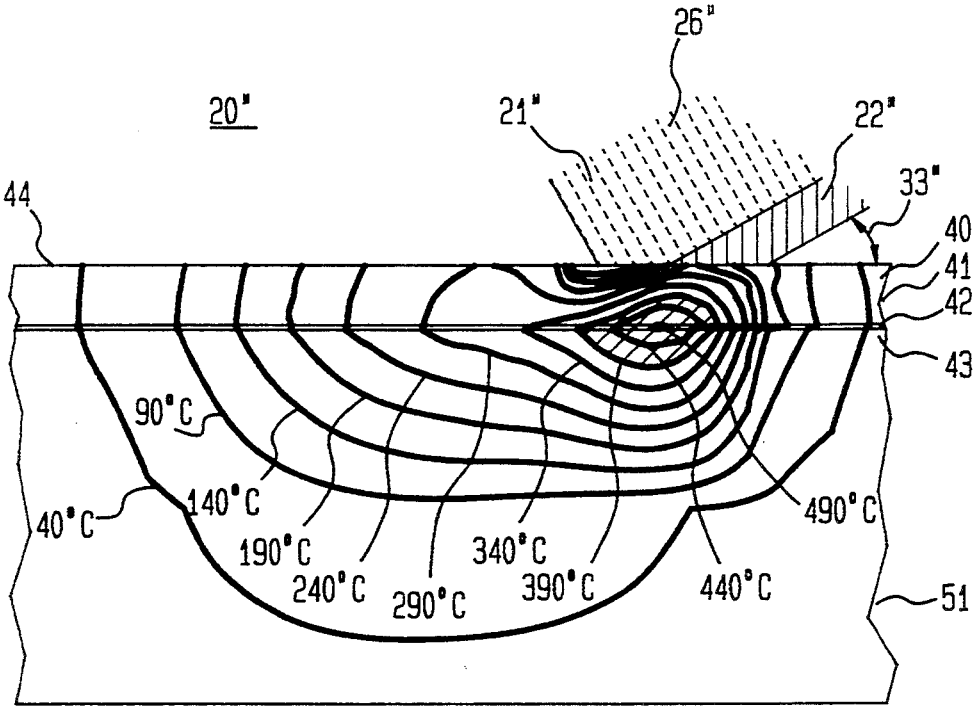
FIG. 8C is a schematic sectional side view showing the calculated size of the dye zone in the resistive ribbon that is above a critical transfer temperature, per FIG. 7, when the substrate has an exposed end face, but without the groove of the present invention, using an arrangement with the comparison print head of FIG. 6.

Referring now to FIGS. 8A, 8B and 8C, based on calculations using the thermal model, the corresponding temperature profiles in terms of the size of the dye zone volume (mass) heated to above the critical dye transfer temperature (shaded areas) are shown for the three cases A, B and D of FIG. 7, in relation to the cross section of the ribbon/receiver composite structure, with the ribbon in sliding pressure contact with the print head and with the ribbon and receiver moving past the stationary print head.

FIG. 8A corresponds to case A use of print head 21" per prior art FIG. 5.

FIG. 8B corresponds to case B use of print head 21 with a groove 28 (0.002 inch; 50 micron) per invention FIGS. 1 to 4.

FIG. 8C corresponds to case D use of print head 21" per comparison FIG. 6.

The temperature zones are shown in increments of 50 degrees C., from a high of 490 degrees C., i.e., above the critical dye transfer temperature of 390 degrees C., to a low of 40 degrees C.

Per case A, as shown in FIGS. 5, 7 and 8A, when there is no exposed substrate end face (contact face) nor groove, the temperature drop is slow, thus elevating a large volume of dye above the critical dye transfer temperature.

Per case D, as shown in FIGS. 6, 7 and 8C, when there is an exposed substrate end face (contact face) but no groove, the maximum temperature for the dye is similar, whereas the volume of the dye above the critical dye transfer temperature is significantly reduced, due to the rapid decay in temperature caused by conduction of heat away from the ribbon by the substrate.

Per case B, as shown in FIGS. 1 to 4, 7 and 8B, when a groove according to the invention is present in the substrate end face, it increases the dye volume above the critical transfer temperature. After travel of the given point in the ribbon across the groove, the dye rapidly cools to halt its transfer when a desired dye volume has been transferred. FIG. 7 shows that the groove can be adjusted to provide the desired dye volume to be transferred, by varying the size of groove entrance width 65 (D5).

With a wider size groove entrance width 65 (D5) per case B, as shown in FIGS. 7 and 8B, a larger volume amount of dye can be transferred in a given time period during travel of the ribbon past the print head at constant speed. With a narrower size groove entrance width 65 (D5) per case C, as shown in FIG. 7, a smaller volume amount of dye can be transferred in such time period of constant speed ribbon travel.

The calculations used to provide the temperature profiles per cases A to D, as shown in FIG. 7, and per cases A, B and D as shown in FIGS. 8A to 8C, are based on a substrate of high thermal conductivity. However, further control can be obtained by using a substrate of low thermal conductivity, as this not only controls the temperature of the electrodes but also the temperature of the dye in the ribbon. A low thermal conductivity substrate more fully limits the rate of heat transfer thereto from the electrodes of heat transferred to the electrodes by the ribbon, and also more fully limits the rate of heat transfer directly to the substrate by the ribbon once it traverses the groove.

The calculations also use pulse count modulation as the electrode pulsing scheme, with the electrodes all being pulsed continuously for simulating printing at maximum optical density.

Hence, the provision for a groove in the substrate at the boundary between the substrate and electrodes permits control of the volume of the dye elevated above a given critical dye transfer temperature. Crisper, sharper images are attainable because there is no temperature spread along the ribbon, since the temperature is localized by the groove, as is clear from FIG. 8B. Without the groove, temperature spread occurs in the ribbon, leading to poor optical density of the resulting images.

The groove of the invention serves to isolate the electrodes from the substrate at their corresponding end faces, and thus delay heat transfer from the ribbon to the substrate during relative movement between the print head and ribbon, as a function of the groove entrance width for a given movement speed per unit time.

A narrow entrance width groove permits a smaller volume of dye to be locally heated above the critical transfer temperature for a shorter delay period before rapid cool down of the ribbon following its contact with the substrate end face after traversing the groove. A wider entrance width groove permits a larger volume of dye to be locally heated above such transfer temperature for a longer delay period before cool down of the ribbon following its contact with the substrate end face after traversing the groove.

In either instance, the rate of cool down of the ribbon can be controlled by selection of the substrate thermal conductivity. By decreasing the substrate thermal conductivity, i.e., using a substrate of low thermal conductivity, the rate of cool down of the ribbon can be retarded. By increasing the substrate thermal conductivity, i.e., using a substrate of high thermal conductivity, the rate of cool down of the ribbon can be accelerated.

The invention thus contemplates a reduction in the sliding contact pressure at the electrode/ribbon interface, by using a print head having an exposed substrate end face, while allowing compensation for the loss of thermal efficiency attendant use of the substrate end face, which results in heat transfer thereto directly from the ribbon, by inclusion of an electrode isolating substrate groove. The groove provides the compensating advantage of controlling the volume amount of dye transferred to the receiver, while permitting rapid cool down of the dye in the ribbon, once the desired dye amount has been so transferred.

The present invention, in effect, balances the undesired rapid cooling of the ribbon, due to direct heat flow contact with the contact pressure reducing increased area provided by the exposed end face of the thermally conductive substrate, by providing a groove in the substrate end face immediately adjacent the row of exposed electrode end faces. The groove interrupts contact of the substrate with the ribbon during its travel for a time sufficient to avoid undesired heat flow from the ribbon to the substrate, while only minimally increasing the contact pressure by an increment corresponding to the decrease in contact area represented by the cross sectional area of the groove entrance.

During this interruption time, the desired dye volume amount remains above the temperature critical for dye transfer to the receiver as selectively sized pixels. Although some heat flows from the ribbon to the electrodes during this time, inefficiently cooling the ribbon and heating the electrodes, and in turn flows from the electrodes to the substrate and then to the heat sink, this heat loss to the electrodes is at a constant and uniform rate determined by the collective area of the electrode end faces.

Any suitable electrode pulsing scheme (current level and pulse width), contact pressure, dye, and image receiver may be used, so long as the attendant advantages of the invention are achieved.

The print head of the invention is distinguished by use of a selective thermal conductivity substrate having an end face interrupted by a groove defined therein from the adjacent end faces of the electrodes for sliding pressure contact of the electrode end faces and substrate end face with the resistive ribbon, such that the groove interrupts otherwise continuous sliding pressure contact so as to inhibit heat transfer thereat and thereby specifically serves to control the dye amount heated to the transfer temperature and in turn the pixel size of the images formed on the receiver.

Accordingly, it can be appreciated that the specific embodiments described are merely illustrative of the general principles of the invention. Various modifications may be provided consistent with the principles set forth.

What is claimed is:

1. A print head for selectively applying electrical energy to a contact surface of an electrically resistive and grounded transfer ribbon bearing heat transferable dye, during sliding pressure contact and relative movement between the print head and ribbon in a movement direction, for selective resistive heating of the dye for transfer to a receiver underlying the ribbon remote from the ribbon contact surface and print head to form images of selective pixel size on the receiver, the print head comprising:

a row of side by side, spaced apart, selectively electrically energizable electrodes comprising electrically conductive, high hardness non-oxide ceramic material, and lying in an electrode plane extending crosswise of said movement direction and terminating in a corresponding row of exposed electrode end faces;

an electrically non-conductive substrate having a selective thermal conductivity comprising electrically non-conductive, high hardness ceramic material, and terminating in an exposed substrate end face; and a groove defined in the substrate end face and extending crosswise of the movement direction and having a groove entrance;

the row of electrodes in the electrode plane and the substrate being in abutment in succession in the movement direction, with the groove interposed to define a boundary, therebetween thermally separating the end faces of the electrodes from the end face of the substrate at their corresponding end faces, and with the row of electrode end faces, groove entrance and substrate end face lying in a contact plane for sliding pressure contact of the electrode end faces and substrate end face with said ribbon contact surface to apply electrical energy from the electrodes to the ribbon to heat said dye to a transfer temperature; and the groove entrance having a selective width between the end faces of the row of electrodes and the end faces of the substrate sufficient to inhibit heat transfer at the groove from the ribbon contact surface to the substrate for controlling an amount of dye heated to the transfer temperature adjacent the groove during said relative movement and in turn the pixel size of the images formed on the receiver.

2. The print head of claim 1 wherein the width of the groove entrance is at least about 20 microns.

3. The print head of claim 1 wherein the width of the groove entrance is about 20 to 50 microns, and the groove has a depth inwardly into the substrate of at least about 10 microns.

4. The print head of claim 1 wherein the electrodes have a Vickers hardness of at least about 1,500, and the substrate has a Vickers hardness of at least about 500.

5. The print head of claim 1 wherein the electrodes comprise a carbide ceramic or nitride ceramic material, and the substrate comprises an oxide ceramic, nitride ceramic or glass-ceramic material.

6. The print head of claim 1 further comprising a heat sink element connected to the substrate remote from the groove and electrodes.

7. The print head of claim 1 wherein the contact plane extends at an acute angle to the electrode plane.

8. A combination of an electrically resistive and grounded transfer ribbon having a contact surface and bearing heat transferable dye, and a print head for selectively applying electrical energy to the contact surface of the ribbon, during sliding pressure contact and relative movement between the print head and ribbon in a movement direction, for selective resistive heating of the dye for transfer to a receiver underlying the ribbon remote from the ribbon contact surface and print head to form images of selective pixel size on the receiver; said print head comprising:

a row of side by side, spaced apart, selectively electrically energizable electrodes comprising electrically conductive, high hardness non-oxide ceramic material, and lying in an electrode plane extending crosswise of said movement direction and terminating in a corresponding row of exposed electrode end faces;

an electrically non-conductive substrate having a selective thermal conductivity comprising electrically non-conductive, high hardness ceramic material, and terminating in an exposed substrate end face; and a groove defined in the substrate end face and extending crosswise of the movement direction and having a groove entrance;

the row of electrodes in the electrode plane and the substrate being in abutment in succession in the movement direction, with the groove interposed to define a boundary therebetween thermally separating the end faces of the electrodes from the end faces of the substrate at their corresponding end faces, and with the row of electrode end faces, groove entrance and substrate end face lying in a contact plane for sliding pressure contact of the electrode end faces and substrate end face with said ribbon contact surface to apply electrical energy from the electrodes to the ribbon to heat said dye to a transfer temperature; and the groove entrance having a selective width between the end faces of the row of electrodes and the end face of the substrate sufficient to inhibit heat transfer at the groove from the ribbon contact surface to the substrate for controlling an amount of dye heated to the transfer temperature adjacent the groove during said relative movement and in turn the pixel size of the images formed on the receiver; and said ribbon comprising:

an upper electrically resistive base layer;

an intermediate electrically resistive ground layer; and a lower heat transferable dye bearing layer comprising dye heatable to a transfer temperature for transfer to a receiver;

the base layer defining said contact surface, and the base layer and ground layer serving to convert electrical energy applied by the electrodes to the ribbon to resistance heat for heating the dye in the dye bearing layer.

9. The combination of claim 8 wherein the width of the groove entrance is at least about 20 microns.

10. The combination of claim 8 wherein the width of the groove entrance is about 20 to 50 microns, and the groove has a depth inwardly into the substrate of at least about 10 microns.

11. The combination of claim 8 further comprising a heat sink element connected to the substrate remote from the groove and electrodes.

12. The combination of claim 8 wherein the contact plane extends at an acute angle to the electrode plane.

* * * * *